US005337449A

United States Patent [19]

Lutzke

[11] Patent Number: 5,337,449

[45] Date of Patent: Aug. 16, 1994

[54] HANDGRIP FOR LINK CHAIN

[76] Inventor: David Lutzke, 18 Maple View Ct., Madison, Wis. 53719

[21] Appl. No.: 33,093

[22] Filed: Mar. 16, 1993

Related U.S. Application Data

[63] Continuation-in-part of Ser. No. 838,318, Feb. 20, 1992, Pat. No. 5,216,780.

[51] Int. Cl.[5] ..... A47B 95/02

[52] U.S. Cl. ..... 16/111 R; 16/114 R; 16/DIG. 12; 472/118

[58] Field of Search ..... 16/111 R, 114 R, DIG. 12; 472/118; 24/116 R

[56] References Cited

U.S. PATENT DOCUMENTS

| | | | |
|---|---|---|---|
| 1,340,904 | 5/1920 | Medart | 472/118 |
| 2,220,629 | 11/1940 | Thirlwell | 24/116 R |
| 3,990,667 | 11/1976 | Tomalinas, Jr. | 472/118 |
| 4,177,542 | 12/1979 | Denney | 16/DIG. 12 |
| 5,197,926 | 3/1993 | Cunard | 472/118 |
| 5,216,780 | 6/1993 | Lutzke et al. | 16/111 R |

*Primary Examiner*—Lowell A. Larson
*Assistant Examiner*—Donald M. Gurley
*Attorney, Agent, or Firm*—Keith Schoff

[57] ABSTRACT

A handgrip for attaching to a link chain to shield a user's hand from injury caused by pinching a flesh, comprised of an elongated sleeve having diametrically opposed recesses therein. The recesses being open at their bottoms for the passing of a threaded fastener therethrough and through a link in the chain passing through the sleeve. A nut received in an associated recess and threaded to the threaded fastener.

1 Claim, 4 Drawing Sheets

HANDGRIP FOR LINK CHAIN

This application is a continuation-in-part of application Ser. No. 07/838,318, filed Feb. 2, 1992, now U.S. Pat. No. 5,216,780.

FIELD OF INVENTION

Link chain is used in applications where manual gripping of the chain is required, as for example, in using a child's swing set. Handholds improve the ease with which chain can be manipulated.

PRIOR ART

Chain grips heretofore have been non-adjustable for use with chain of any link length, and have also been unsuitable for shielding a user's hand from injury caused by pinching of flesh in any gap created by spreading and separation of grip components when stressed by chain being bent within a grip, as by pumping of swing chain.

SUMMARY OF THE DISCLOSURE

A chain grip is disclosed which is universally adaptable for use with chain of any link length. The grip comprises two components which are preferably of identical, semi-tubular configuration. The configuration is preferably such that the components can be arranged to form a sleeve around a length of chain with mating edges disposed to overlap or interleaf and be slidable lengthwise with respect to one another. Preferably, a transversely extending post portion projects from each component for passing through a link in a chain and being secured to the opposite component by a screw being inserted through a countersunk slot in the wall of the opposite component and being operably driven through the end face of the post portion. The distance between the post portions can be adjusted to accept any length of chain link by shifting the components longitudinally with respect to each other thereby to relocate the screw within the slots and, in consequence, displace the end faces of the components from alignment.

DESCRIPTION OF THE INVENTION

Figure 1:
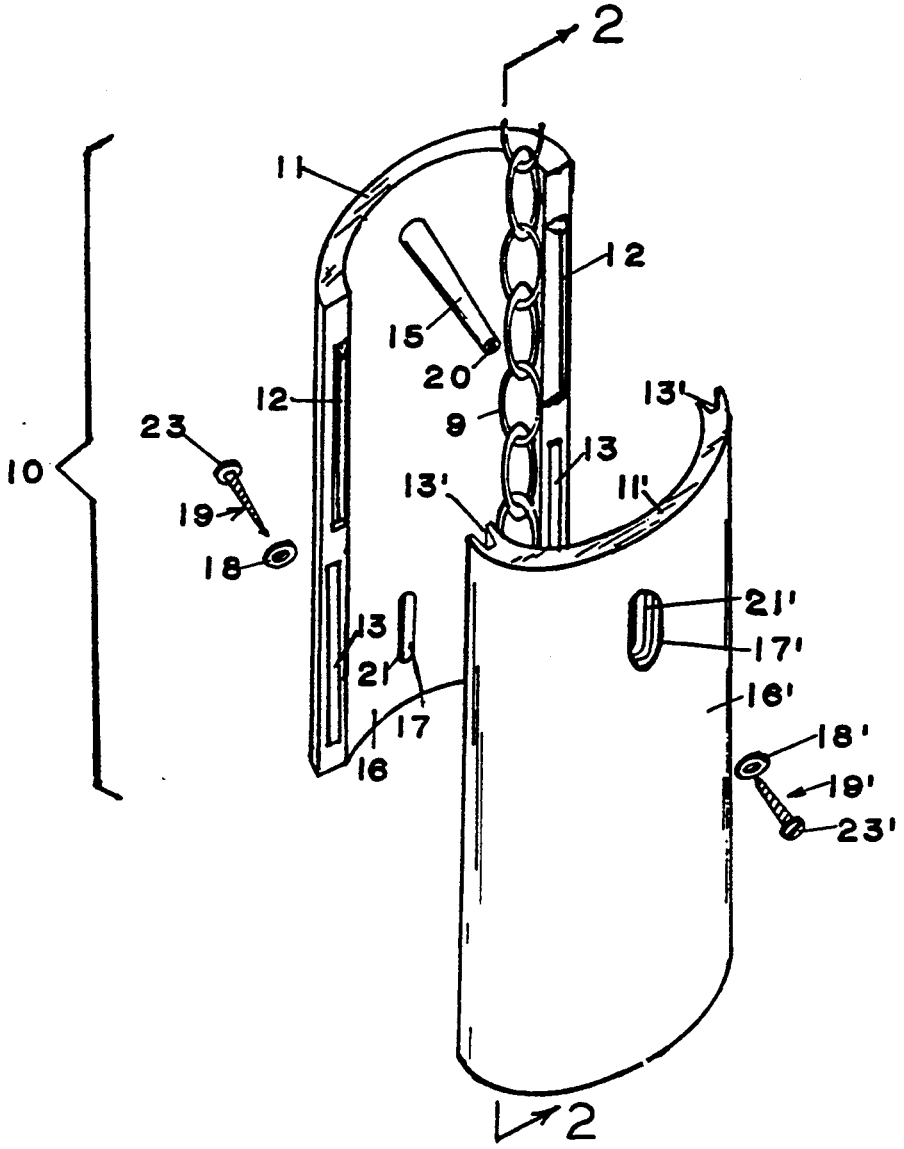
FIG. 1 is an exploded perspective view of two components of a grip of this invention shown in relation to a chain which they encircle when operably connected.
Figure 2:
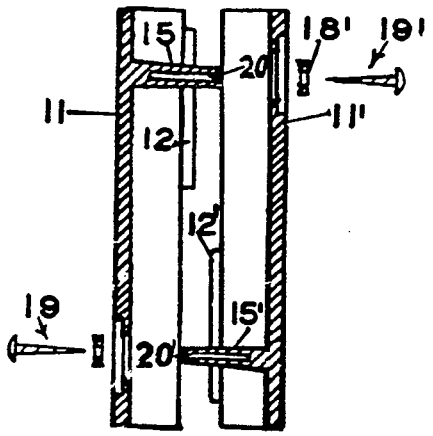
FIG. 2 is an elevation view in cross-section of the components of FIG. 1.

In FIGS. 1 and 2 hand grip 10 is shown comprising two identical semi-tubular components 11, 11'. The components are shown mutually inverted with abutting edges configured with tenons 12, 12' (FIG. 2) disposed to be received in mortises 13, 13' (FIG. 1). Mortises 13, 13' are longer than tenons 12, 12' to enable the components 11, 11' to be adjusted longitudinally with respect to each other so that the end faces of the grips may be displaced in alignment without disposition of interleaf-ing tenons 12, 12' in mortises 13, 13' being disturbed.

Post portions 15, 15' of components 11, 11' are shown to perpendicularly project from wall portions 16, 16' and be conically tapered to provide a draft angle for removal from injection molding dies. Openings 20, 20' are provided in the end faces of post portions 15, 15' for receiving screw threaded means 19, 19' operably therein.

Wall portions 16, 16' of components 11, 11' are provided with countersunk, slot configured openings 17, 17'. Shoulders 21, 21' of the countersinking provide a surface upon which washers 18, 18' rest so that the heads 23, 23' of screw threaded means 19, 19' will be recessed below the extended outer surface of sleeve configured grip 10 when the components 11, 11' are operably joined by screw threaded means 19, 19' being drawn tightly into openings 20, 20' of post portions 15, 15'.

Components 11, 11' are preferably made from pliable thermoplastic resin, such as polyethylene or polypropylene, although any other suitable material may be used. A preferred method of manufacture is injection molding.

Openings 17, 17' in wall portions 16, 16' of components 11, 11' are elongated in the axial direction of grip 10. Elongation of openings 17, 17' enables the components 11, 11' to adjusted lengthwise with respect to one another with the result that the distance separating post portions 15, 15' can be varied as necessary to accommodate chain links of any length. Thus, if at a given setting of separation distance between post portions 15, 15', interference between a link and one of the post portions occurs when engaging components 11, 11' with chain to install grip 10 on the chain, the alignment of the ends of components 11, 11' can be staggered until the obstruction preventing passage of a post portion through a chain link is avoided and the components 11, 11' can be operably engaged and joined with the end extremities of the components remaining in staggered disposition. The extent of such staggered alignment is dependent upon the lengths of slot in opening's 17, 17' . In a preferred embodiment, the length of slot in openings 17, 17' is great enough so that the clear distance between the extreme positions of a post portion 15, 15' while it is operably engaged by a screw threaded means 19, 19' disposed in an opening 17, 17'is at least equal the length of any obstruction, measured in an axial correction of the chain, which may be encountered by a post portion 15, 15' in being inserted through the chain. The minimum length of such clear distance would be twice the thickness of a chain link and the maximum distance would be the distance measured axially of a chain that is occupied by bent-wire closure in the case of wire chain or other coupling of chain which is not composed of forged or welded links such as is crane or hoisting chain.

For use of a chain grip on a child's swing set, for example, openings 17, 17' might be approximately one inch in length and 0.2 inch in width, with mortises 13, 13'being approximately 0.1 inch in depth, and handle components 11, 11' each being eight inches in length. Grip 10 might have an outside diameter of one and one-eighth inches for use in such an application, and would be proportionately larger for use with heavier chain.

Figure 3:
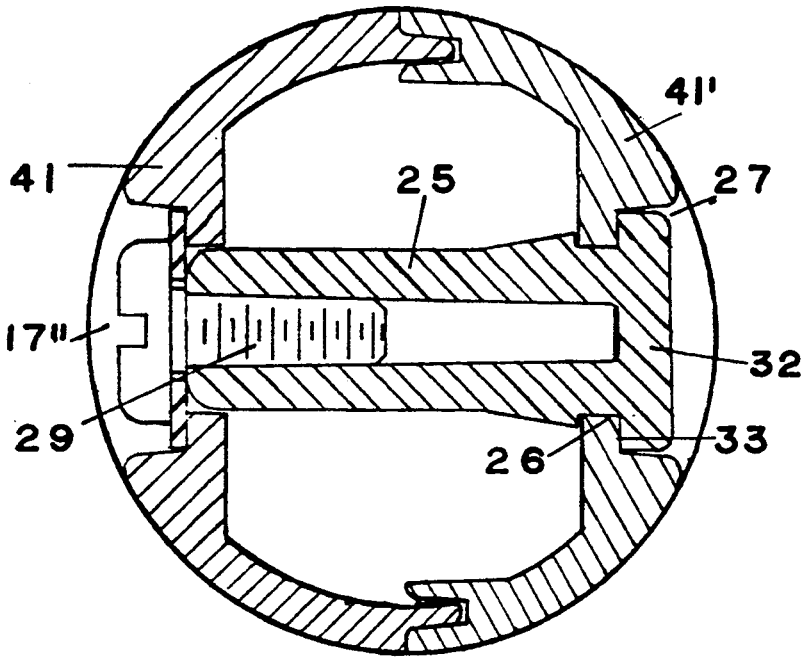
FIG. 3 is an end elevational view of another embodiment.

In FIG. 3, another, non-preferred embodiment of the invention is shown in which post portions 15, 15' of FIGS. 1 and 2 are replaced by plug members 25 which are disposed to be inserted in added slot configured openings 27 disposed in identically configured grip components 41, 41' with head 32 portions resting on shoulders 33 of coutersunk openings 27. Plug members 25 are hollow for operably receiving the threaded stem of screws 29. In the embodiment of FIG. 3, grip components 41, 41' can be of any desired length, and any desired number of openings 27 can be provided in each grip component 41, 41' with accompanying plug members 25, and further, the end faces of grip components 41, 41' may be aligned in all installations. The embodiment of FIG. 3 is not preferred because a greater number of parts, that is, the additional plug members 25, is required than for the embodiment of FIGS. 1 and 2. To reduce the possibility that plug members might be separated and lost prior to assembly and installation of a grip, annular recess 26 is provided immediately beneath head portion 32 of plug member 25, dimensioned to provide snap-in assembly in opening 27. Plug members 25 may slide longitudinally in opening 27 in operable manner, but may be disengaged from the openings 27 only by forcible deformation of the plastormeric material from which grip 41, 41' components are preferably made. Opening 27 in the embodiment of FIG. 3 are preferably identical to opening 17'' in which screws 29 are seated, with both opening 27 and 17'' being proportionally identical to opening 17, 17' of FIGS. 1 and 2.

Figure 4:
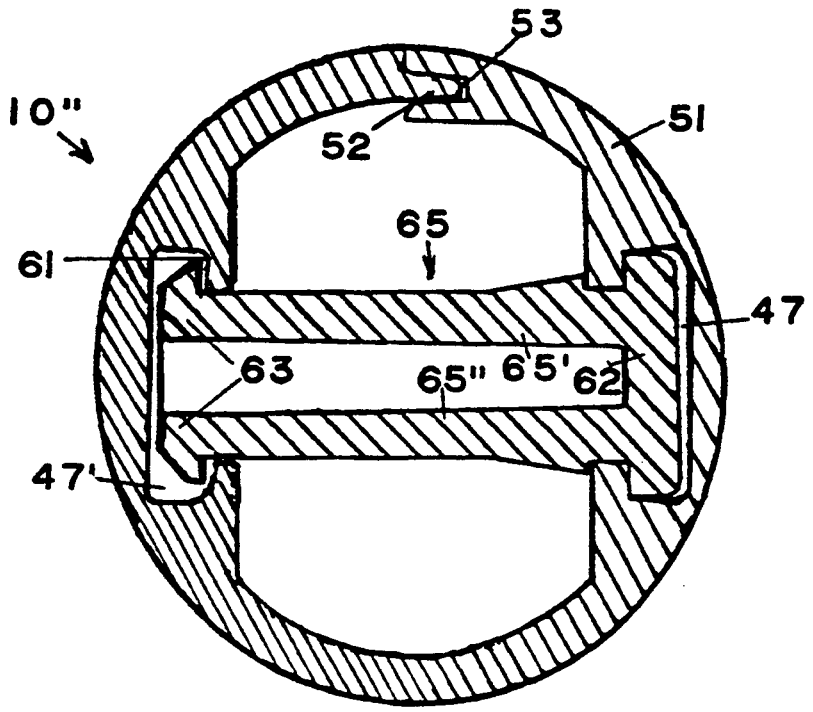
FIG. 4 is a cross-sectional end elevation of another embodiment.

In FIG. 4 grip 10'' is illustrated as a further embodiment of the invention in which a single component, surround 51, constitutes the entire gripping surface. Mating edge portions of surround 51 are configured, one as tenon 52 and the other as mortise 53, to run the full length of the grip. Similarly, channels 47, 47' in the wall of surround 51 extend the full length of surround 51, and receive therein, respectively, head portion 62 and resiliently spread foot portion 63 of plug member 65. Multiple plug members 65 are preferably provided in each grip 10'', disposed through chain links in the manner of plug member 25 of FIG. 3, with placement of plug members 65 preferably being made close to the end extremities of grip 10'' to enable a person to reach the plug member either manually or by use of a long nosed pliers or other tool and squeeze tine portions 65' and 65'' together to displace foot portion 63 from engagement on shoulder 61 of channel 47'. Surround 51 can then be spread to remove tenon 52 from engagement with mortise 53 and enable plug 65 to be removed from engagement in a chain link, and also from engagement in channel 47, if desired, in which it is otherwise tightly gripped when surround 51 is tightly closed with edge portions engaged. The material from which plug member 65 is formed may be the same or similar material to that above disclosed or may be of stiffer material to more forcefully spread tine portions 65', 65'' apart when foot portion 63 of plug member 65 is seated on shoulder 61 of channel 47'. Flexure of surround 51 during spreading will occur principally where the wall thickness of surround 51 is of least dimension at the width extremes of channels 47, 47'. Surround 51 and plug member 65 may both be sectioned from extruded stock, and to any desired length, thereby lending versatility and economy of construction, both in manufacturing procedure and number of parts, to the embodiment. It will be recognized, however, that washers shown in FIGS. 1-3 embodiments may be eliminated from those embodiments, if desired, or plug member 65 be used in FIG. 3.

Figure 5:
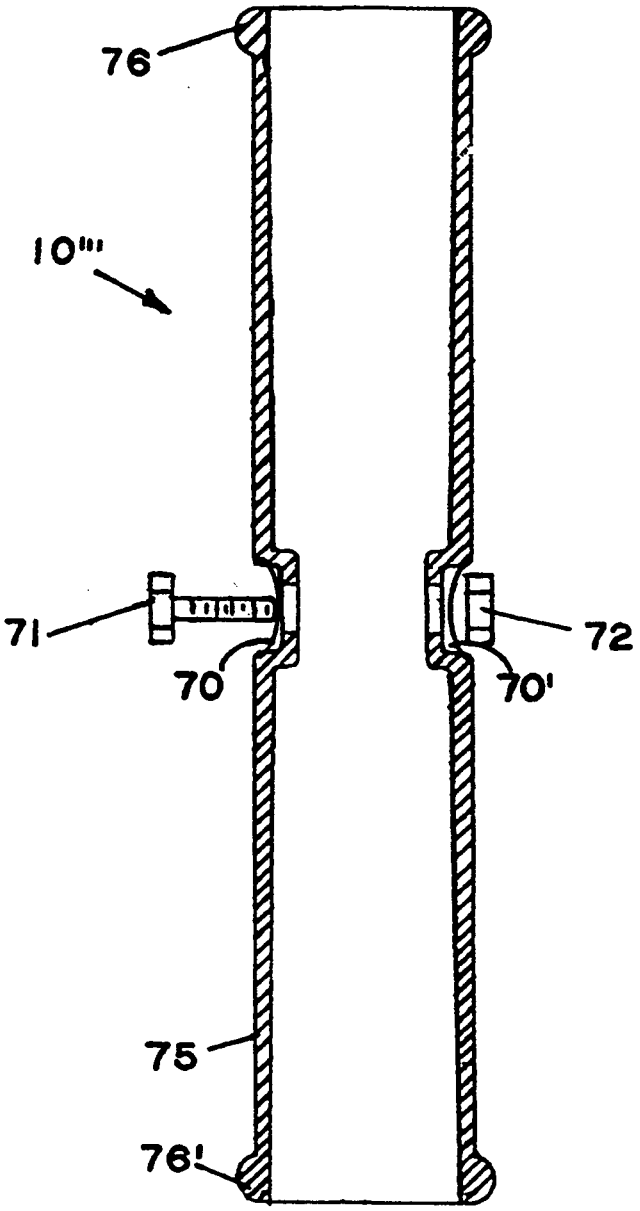
FIG. 5 is a cross-sectional elevation of another embodiment

FIG. 5 discloses another embodiment of the invention wherein chain grip 10''' is configured as a one-piece sleeve which is applied to a chain by being slipped over the end of a length of chain so that the chain is drawn through the sleeve to the point where it is to be secured. Recesses 70, 70' in the sleeve are diametrically opposed at midlength of the sleeve to provide a substantially flush mounting for headed fastener 71 and nut 72. Bolt fastener 71 as shown is inserted through openings 73, 73' in the bottom of recesses 70, 70', respectively, and is secured by affixing nut 72 in operable manner. Bolt 71 also is caused to pass through a chain link, not shown, within the sleeve to anchor the sleeve to a chain.

Sidewall 75 of the sleeve is tapered from lesser thickness adjacent molded collar portions 76, 76' at the endmost extremities of the sleeve to greater thickness at mid-length to provide maximum resistance to bending under stress imposed on the sleeve during use, particularly by a user of the grip when installed on chain of a child's swing when he is "pumping" in order to increase the amplitude of swing motion. The provision of a tapered wall thickness minimizes the amount of material in grip 10''' necessary to achieve a given resistance to bending of the grip at mid-length in reaction to pulling of a child and bending of the chain in one direction at that point and the force of the bent chain at the collared end extremities of the grip in the other direction. In this manner, the grip diameter can be maintained at a minimal dimension for use with a particular size chain as is desirable for accommodating the small hands of young children adequately.

Recesses 70, 70' are preferably circularly coaxial with opening 73, 71', and fastener 71 preferably can be turned by use of a screw driver or Allen wrench so that the size of recesses 70, 70' can be minimized.

I claim:

1. A hand grip for link chain comprising a) an elongated sleeve configured with diametrically opposed recesses disposed oppositely facing substantially at mid-length of the sleeve wherein each said recess is provided with an opening in the bottom thereof, said opening being disposed axially transverse to the axis of said sleeve, and further wherein the wall-thickness of said sleeve tapers in dimension substantially from the endmost extremities of said sleeve which thickness is minimum to mid-length of said sleeve where thickness is maximum, b) a threaded fastener disposed to extend through said openings in the bottom of each said recess, c) a threaded nut for said threaded fastener, whereby said sleeve when having a chain threaded therethrough is secured to said chain by passing said threaded fastener through a chain link and attaching said nut.

* * * * *